US009166299B2

(12) United States Patent
Chen et al.

(10) Patent No.: US 9,166,299 B2
(45) Date of Patent: Oct. 20, 2015

(54) RIDGED WAVEGUIDE SLOT ARRAY

(71) Applicants: Ming H. Chen, Rancho Palos Verdes, CA (US); Chin-Yi Chu, Xizhi (TW); Di-Shang Hsu, Wujie Township (TW)

(72) Inventors: Ming H. Chen, Rancho Palos Verdes, CA (US); Chin-Yi Chu, Xizhi (TW); Di-Shang Hsu, Wujie Township (TW)

(73) Assignee: Victory Microwave Corporation, New Taipei (TW)

( * ) Notice: Subject to any disclaimer, the term of this patent is extended or adjusted under 35 U.S.C. 154(b) by 185 days.

(21) Appl. No.: 14/072,573

(22) Filed: Nov. 5, 2013

(65) Prior Publication Data

US 2014/0055311 A1 Feb. 27, 2014

Related U.S. Application Data

(63) Continuation of application No. 12/471,367, filed on May 23, 2009, now Pat. No. 8,604,990.

(51) Int. Cl.
*H01Q 13/10* (2006.01)
*H01Q 21/00* (2006.01)

(52) U.S. Cl.
CPC ..... *H01Q 13/10* (2013.01); *H01Q 21/0043* (2013.01)

(58) Field of Classification Search
USPC ..... 343/702, 767–771
See application file for complete search history.

(56) References Cited

U.S. PATENT DOCUMENTS

| | | | | |
|---|---|---|---|---|
| 2,772,400 | A | 11/1956 | Simmons | |
| 3,193,830 | A * | 7/1965 | Provencher | 343/771 |
| 3,949,405 | A * | 4/1976 | Roquencourt | 343/771 |
| 4,638,323 | A | 1/1987 | Shnitkin et al. | |
| 5,579,015 | A | 11/1996 | Collignon | |
| 5,638,079 | A * | 6/1997 | Kastner et al. | 343/770 |
| 5,914,694 | A | 6/1999 | Rabb | |
| 6,127,985 | A | 10/2000 | Guler | |
| 6,509,881 | B2 * | 1/2003 | Falk | 343/771 |
| 7,307,596 | B1 * | 12/2007 | West | 343/778 |
| 7,327,325 | B2 | 2/2008 | Schadler | |
| 7,554,504 | B2 | 6/2009 | Mohamadi | |
| 2005/0219136 | A1 | 10/2005 | Iskander et al. | |
| 2006/0114165 | A1 | 6/2006 | Honda et al. | |
| 2006/0132374 | A1 * | 6/2006 | Wang | 343/770 |
| 2009/0022445 | A1 * | 1/2009 | Hochberg et al. | 385/3 |
| 2010/0187442 | A1 * | 7/2010 | Hochberg et al. | 250/492.1 |
| 2012/0033294 | A1 * | 2/2012 | Beausoleil et al. | 359/341.3 |

FOREIGN PATENT DOCUMENTS

CN 101562280 10/2009

OTHER PUBLICATIONS

English language abstract for CN 101562280.

* cited by examiner

*Primary Examiner* — Huedung Mancuso
(74) *Attorney, Agent, or Firm* — Clifford Perry

(57) ABSTRACT

A ridged waveguide slot array includes a waveguide slot body and a ridged waveguide section attached to the waveguide slot body. The waveguide slot body includes one or more walls having a plurality of slots disposed thereon. The ridged waveguide section includes two spaced apart opposing ridges disposed on the one or more walls of the waveguide slot body, and extends along the longitudinal axis of the waveguide slot body.

8 Claims, 7 Drawing Sheets

RIDGED WAVEGUIDE SLOT ARRAY

CROSS-REFERENCE TO RELATED APPLICATIONS

The present application is a continuation of U.S. Ser. No. 12/471,367 filed May 23, 2009, the contents of which are incorporated herein in its entirety for all purposes

BACKGROUND

The present invention relates to waveguide antenna, and particularly to ridged waveguide slot array antennae.

Waveguide slot array antennae are well known in the art, and are typically employed for providing high power capability in applications, such as base station transmitting antenna arrays.

FIG. 1A illustrates a conventional vertically-polarized waveguide slot array 100 as known in the art. The array 100 includes a waveguide slot body 110 which is operable to support the propagation of a signal along a longitudinal axis 112 (z-axis) of the waveguide slot body 110. Transverse to the longitudinal axis 112, the waveguide slot body 110 defines a waveguide aperture having a major dimension 113 (along the x-axis) and a minor dimension 114 (along the y-axis). The major dimension 113 defines the lowest frequency of operation for the array 100, and is typically 0.5 λ in its dimension. The waveguide slot body 110 further includes edge slots 122 and 124, each angled a in respective positive and negative angular orientations relative to the axis of the minor dimension 114. An end cap 130 is located at the top of the array 100.

FIG. 1B illustrates typical radiation patterns 150 for the vertically-polarized waveguide slot array 100 of FIG. 1A. The patterns 150 include an azimuth radiation pattern 152 and an elevation pattern 154. The azimuth radiation pattern 152 exhibits 8 dB variation, as shown.

FIG. 2A illustrates a conventional horizontally-polarized waveguide slot array 200 with horizontal polarization as known in the art. The array 200 includes a waveguide slot body 210 which is operable to support the propagation of a signal along a longitudinal axis 212 (z-axis) of the waveguide slot body 210. Transverse to the longitudinal axis 212, the waveguide slot body 210 defines a waveguide aperture having a major dimension 213 (along the x-axis) and a minor dimension 214 (along the y-axis). The major dimension 213 defines the lowest frequency of operation for the array 200, and is typically 0.5 λ in its dimension. The waveguide slot body 210 further includes longitudinal slots 220, each slot offset a predefined distance from a center line defining the major axis 212 of the waveguide body 210, adjacent slots offset in opposing directions from the center line. An end cap 230 is located at the top of the array 200.

FIG. 2B illustrates typical radiation patterns 250 for the horizontally-polarized waveguide slot array 200 of FIG. 2A. The patterns 250 include an azimuth radiation pattern 252 and an elevation pattern 254. The azimuth radiation pattern 252 exhibits 4 dB variation, as shown.

As can be observed, the azimuth radiation patterns for each of the conventional vertically and horizontally-polarized waveguide slot arrays vary significantly over the coverage area, meaning that signal levels over these coverage areas vary greatly as a function of the user's position. As a result, a high power transmitter or a high gain antenna is needed to ensure that the minimum signal level is provided to all users, independent of their location. Accordingly, although slot arrays are suitable for high power transmission and reception applications, they cannot be fully deployed in applications where more uniform coverage is needed.

What is accordingly needed is a waveguide slot array which can provide a more uniform radiation pattern.

SUMMARY

In accordance with one embodiment of the present invention, a ridged waveguide slot array which operates to provide a more uniform radiation pattern compared to conventional waveguide slot arrays is now presented. An exemplary embodiment of the ridged waveguide slot array includes a waveguide slot body and a ridged waveguide section attached to the waveguide slot body. The waveguide slot body includes one or more walls having a plurality of slots disposed thereon. The ridged waveguide section includes two spaced apart opposing ridges disposed on the one or more walls of the waveguide slot body and extends along the longitudinal axis of the waveguide slot body.

In one embodiment, the waveguide slot body defines a waveguide aperture having a major dimension and a minor dimension, wherein the major dimension of the waveguide aperture is less than one-half wavelength of a signal intended for propagation therein.

In another embodiment, the ridged waveguide section is disposed substantially along the longitudinal center line of the waveguide slot body. In such an embodiment, the slots are edge slots which are disposed generally perpendicular to the longitudinal axis of the waveguide slot body.

In a further embodiment, the ridged waveguide section includes first and second ridged waveguide sections which extend longitudinally along opposing lateral sides of the waveguide slot body. In such an embodiment, the slots are longitudinal slots disposed along the longitudinal axis of the waveguide slot body.

These and other features of the invention will be better understood in light of the following detailed description and drawings.

For clarity, previously identified features retain their reference indicia in subsequent drawings.

DETAILED DESCRIPTION OF EXEMPLARY EMBODIMENTS

In accordance with the present invention, a ridged waveguide slot array is presented which provides improved performance. The new slot array includes a waveguide slot body having one or more walls which define a longitudinal axis of the waveguide slot body, and a plurality of waveguide slots disposed on the one or more walls of the waveguide slot body. The new slot array further includes a ridged waveguide section which is attached (directly or indirectly via an intervening structure) to the waveguide slot body, the ridged waveguide section including two spaced-apart opposing ridges that attach (directly or indirectly) to the one or more walls of the waveguide slot body, and that extend along the longitudinal axis of the waveguide slot body. The attaching of a ridged waveguide section to the waveguide slot body allows for advantages, such as a more uniform radiation pattern and smaller cross-sectional dimensions of the structure compared to conventional waveguide slot arrays.

In a particular embodiment, the waveguide slot body implemented in the present invention defines a waveguide aperture having a major dimension and a minor dimension, whereby the major dimension of the waveguide aperture is smaller than 0.5 $\lambda$ (the minor dimension is smaller than the major dimension in order for the major dimension to define the lowest operating mode of the waveguide array). In one embodiment, the major dimension is less than 0.4 $\lambda$, and in still another embodiment, the major dimension is less than 0.35 $\lambda$. The reduction in size across the major axis of the waveguide slot body (i.e., the "A" dimension of the waveguide aperture) permits closer slot spacing, thus providing a more uniform azimuth antenna pattern.

In one embodiment, a vertically-polarized ridged waveguide slot array is disclosed in which the ridged waveguide section is disposed substantially along the longitudinal center of the waveguide slot body. In another embodiment, a horizontally-polarized ridged waveguide slot array is disclosed in which the ridged waveguide section is realized as two ridged waveguide sections which extend longitudinally along opposing lateral sides of the waveguide slot body.

The following embodiments illustrate dimensions of the ridged waveguide slot array for a desired frequency of operation of 542-580 MHz, although the invention may be employed at any frequency, for example, any RF or Microwave frequency, such as one or more frequencies over the range of 100 MHz to 40 GHz.

Figure 1A:
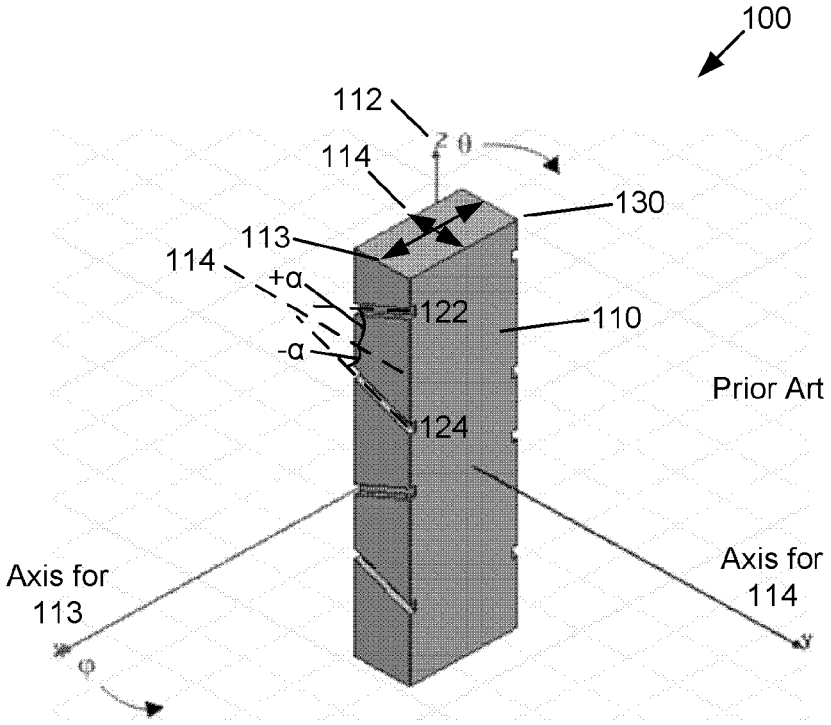
FIG. 1A illustrates a conventional vertically-polarized waveguide slot array as known in the art.
Figure 1B:
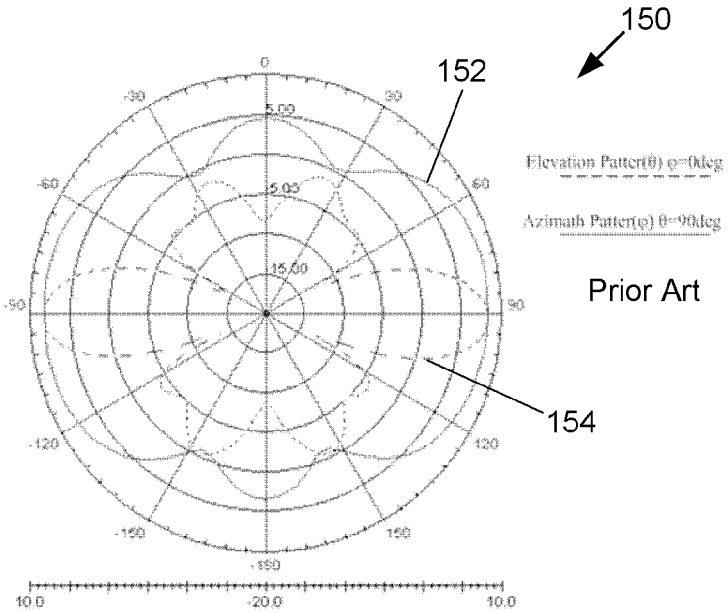
FIG. 1B illustrates a typical elevation and azimuth radiation pattern for the vertically-polarized waveguide slot array of FIG. 1A.
Figure 2A:
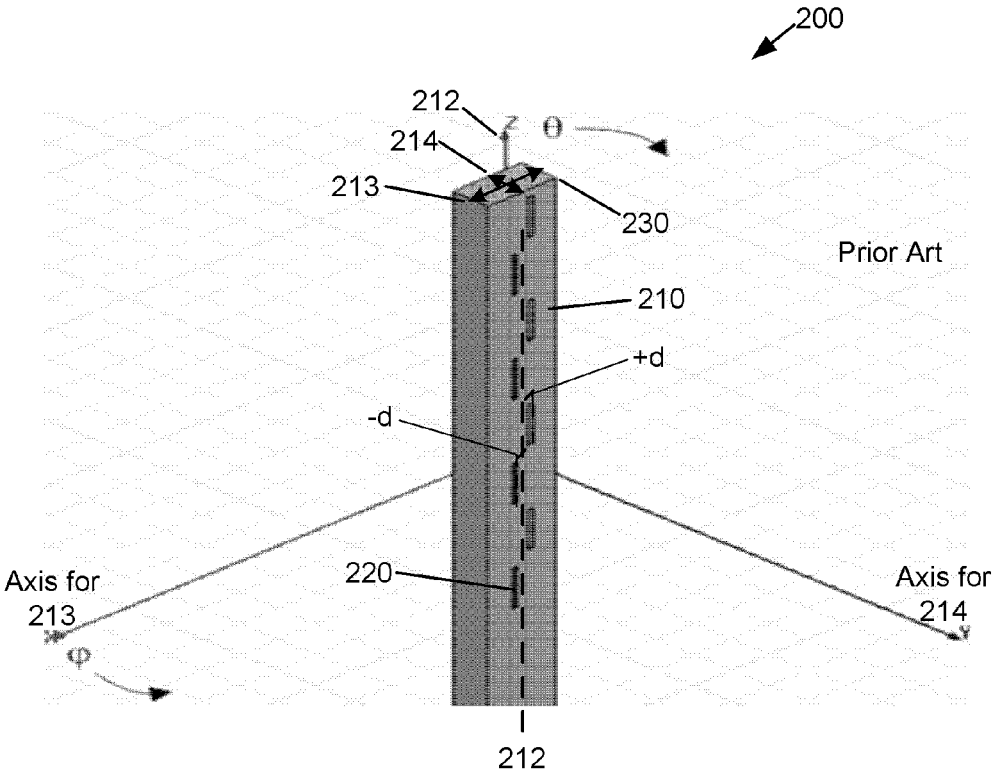
FIG. 2A illustrates a conventional horizontally-polarized waveguide slot array as known in the art.
Figure 2B:
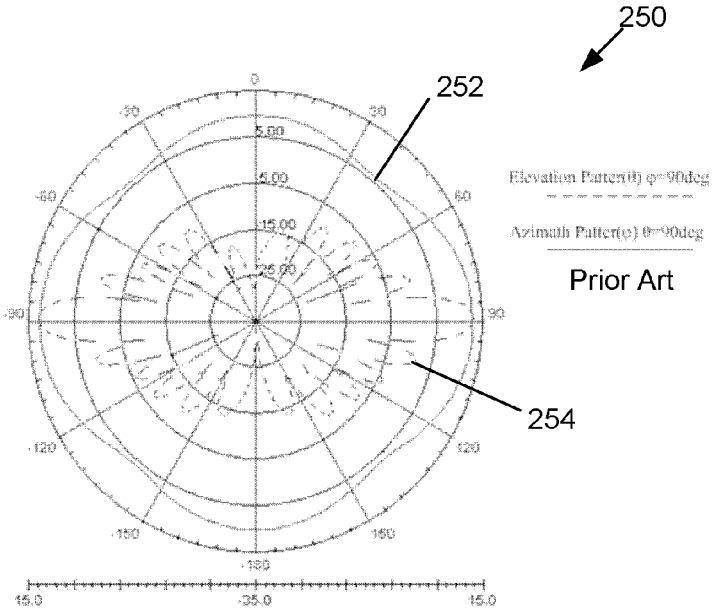
FIG. 2B illustrates a typical elevation and azimuth radiation pattern for the horizontally-polarized waveguide slot array of FIG. 2A.
Figure 3A:
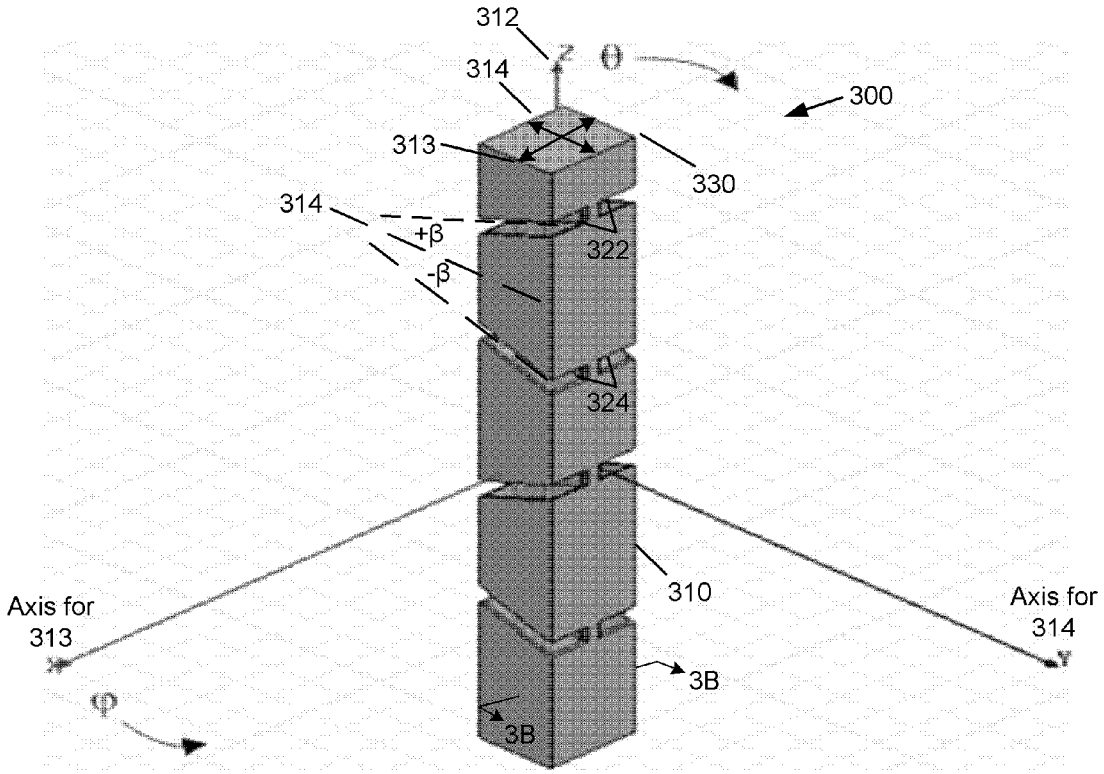
FIG. 3A illustrates a perspective view of a vertically-polarized ridged waveguide slot array in accordance with one embodiment of the present invention.

FIG. 3A illustrates a perspective view of a vertically-polarized ridged waveguide slot array provided in accordance with one embodiment of the present invention. The array 300 includes a waveguide slot body 310 having edge slots 322 and 324 disposed thereon. The waveguide slot body 310 is oriented along a longitudinal axis (exemplary shown as the z-axis) 312 which is the direction of propagation of a signal injected therein.

Transverse to the longitudinal axis 312, the waveguide slot body 310 defines a waveguide aperture (further detailed below) having a major dimension 313 (shown along the x-axis) and a minor dimension 314 (shown along the y-axis). The major dimension 313 defines the lowest frequency of operation for the array 300, and in one embodiment, is less than 0.5 $\lambda$ in its dimension. The waveguide slot body 310 further includes edge slots 322 and 324, each angled $\beta$ in respective positive and negative angular orientations relative to the axis of the minor dimension 314. Further exemplary, each of the edge slots 322 and 324 extend around multiple sides of the waveguide body 310, and in a particular, extend around the entire periphery of the waveguide body 310. In the illustrated embodiment in which the waveguide body 310 is a rectangular waveguide, the edge slots 322 and 324 extend to all four walls of the waveguide body 310. Further particularly, the edge slots 322 and 324 are angled relative to the axis of the minor dimension 314 along two walls of the waveguide body 310, and are not angled (relative to the major dimension 313) along the two other walls of the waveguide body. An end cap 330 is located at the top of the array 300.

Figure 3B:
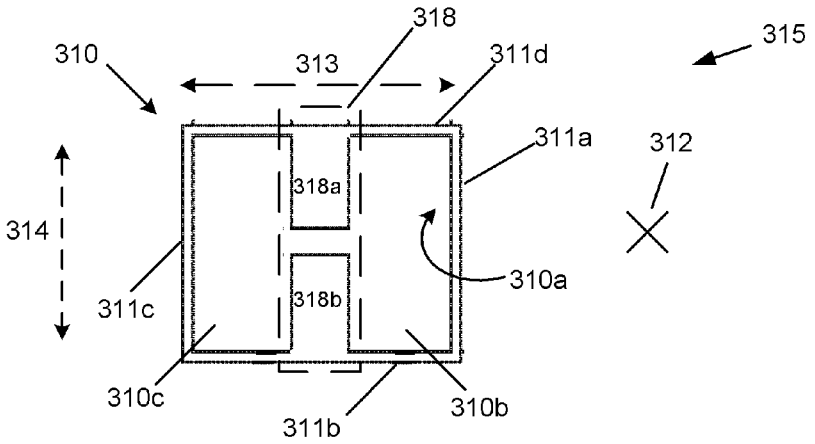
FIG. 3B illustrates an exemplary waveguide aperture for the vertically-polarized ridged waveguide slot array shown in FIG. 3A.

FIG. 3B illustrates an exemplary waveguide aperture 315 for the vertically-polarized ridged waveguide slot array 300 shown in FIG. 3A. The edge slots 322 and 324 are not shown so as to avoid obscuring the figure. The waveguide aperture 315 has a major dimension 313 and a minor dimension 314. Along the axis of the minor dimension 314 and on the internal surface 310*a* of the waveguide body 310, a ridged waveguide section 318 is attached to the waveguide slot body 310. The ridged waveguide section is composed of two opposing ridges 318*a* and 318*b* that extend along the longitudinal center line (extending into/out of the plane of the drawing) of the slot waveguide body 310, as shown. Collectively, the opposing ridges 318*a* and 318*b* create two waveguide sub-sections 310*b* and 310*c* which emulate the operation of a waveguide section of a larger cross-sectional dimension. In an exemplary embodiment, dimension 313 is 0.34 $\lambda$, and dimension 314 is 0.28 $\lambda$, with ridges 318*a* and 318*b* having a width (horizontal dimension) as 0.073 $\lambda$, and spaced apart by a gap of 0.035 $\lambda$. Exemplary, the cross-sectional dimension of sub-sections 310*b* and 310*c* is 0.31 $\lambda\times0.134\ \lambda$. In a particular embodiment, the two spaced-apart ridges 318*a* and 318*b* provides capacitive coupling along the longitudinal center line of the waveguide slot body 310. While the ridged waveguide section 318 is illustrated as two spaced-apart opposing ridges, those skilled in the art will appreciate that the same electrical effect can be obtained using other means, for example a single ridge which extends from the upper or lower wall to close proximity to the opposing wall to provide the desired (e.g., capacitive) coupling effect therebetween. Further, the same electrical effect can be obtained using discrete components, such as capacitive elements disposed along the longitudinal center line of the waveguide slot body 310.

The exemplary waveguide slot body 310 includes two side walls 311*a* and 311*c* and two broadside walls 311*b* and 311*d*. Further particularly, the edge slots 322 and 324 are angled relative to the axis of the minor dimension 314 along the two side walls 311*a* and 311*c* of the waveguide slot body 310, and are not angled (relative to the major dimension 313) along the two broadside walls 311*b* and 311*d* of the waveguide slot body 310.

Figure 3C:
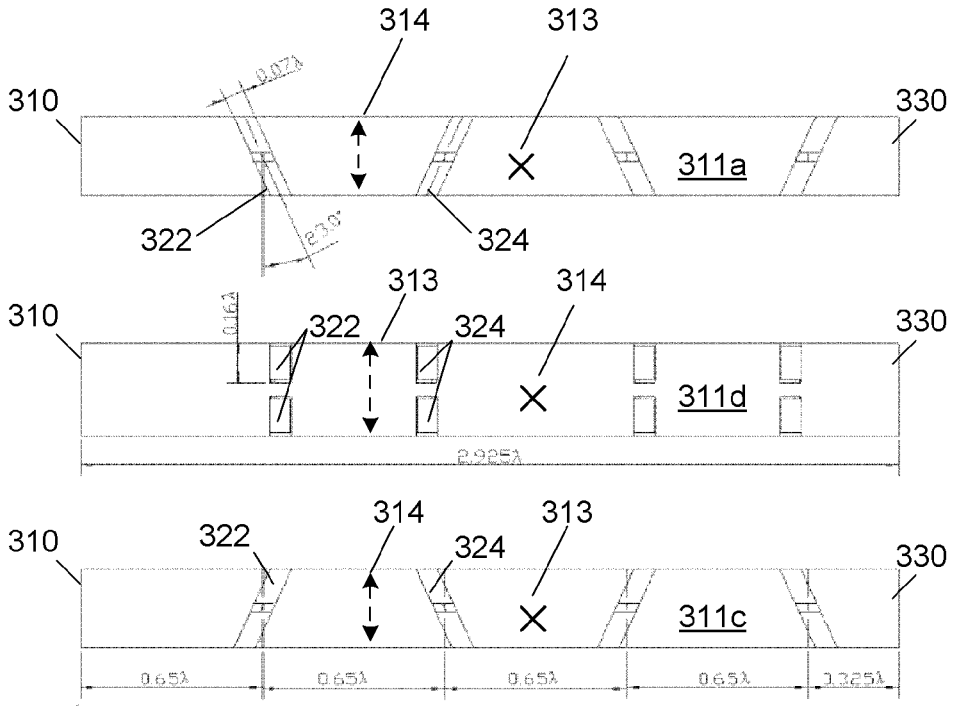
FIG. 3C illustrates views of broadside and side surfaces of the vertically-polarized ridged waveguide slot array shown in FIG. 3A.

FIG. 3C illustrates views of side walls 311*a*, 311*c* and broadside walls 311*d*. Edge slots 322, 324 are disposed on at least one of the side walls 311*a*, 311*c*. In particular, first edge slot 322 is disposed at a predefined angle beta β in a positive angular orientation relative to the axis of the minor dimension 314. Complementary, a second edge slot 324 is located adjacent to the first edge slot 322 and is disposed at said predefined angle β in a negative angular orientation relative to the axis of the minor dimension 314. The predefined angle β may range from a number of values, for example, 0 degrees to 90 degrees or more particularly 0 degrees to 45 degrees. In one embodiment, 0 is 23 degrees. In an exemplary embodiment, the edge slots 322 and 324 are complementary-angled 23 degrees relative to the axis of the body's minor dimension 314, so as to provide in-phase contributions. The exemplary slots have a width 0.07 λ, and are spaced 0.65 λ apart, and the end cap/short 330 is spaced 0.325 λaway from the center of the most proximate slot. Four slots are shown with the antenna 300 having a total length of 2.925 λ, although a different number of slots may be implemented in accordance with the invention.

Further exemplary of the ridged waveguide slot array with vertical polarization, each edge slot extends to each of (i.e., at least reaches) the two side walls 311*a*, 311*c* and to each of the broadside walls 311*b*, 311*d*. That is, the edge slots 322 and 324 extend to all four sides of the body 310, as the length of each edge slot 322 and 324 approaches 0.5 λ, and because the cross-section of the body 310 is reduced.

Figure 3D:
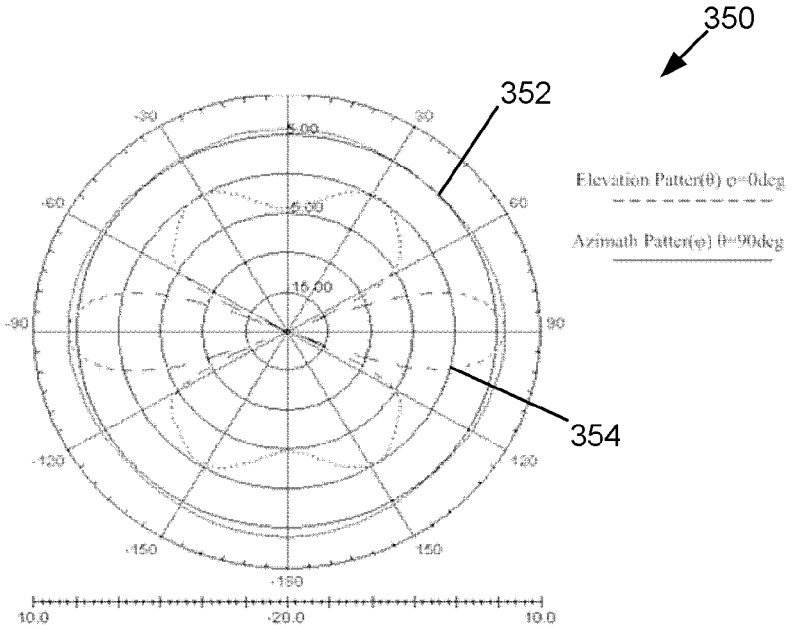
FIG. 3D illustrates elevation and azimuth radiation patterns for the vertically-polarized ridged waveguide slot array shown in FIG. 3A.

FIG. 3D illustrates elevation and azimuth radiation patterns for the vertically-polarized ridged waveguide slot array of FIGS. 3A-3C. As can be seen, the ridged waveguide slot array 300 has a more uniform azimuth radiation pattern 352, exhibiting less than 1 dB compared to 8 dB to the azimuth radiation pattern 152 of the conventional slot array. In exemplary embodiments, the vertically-polarized ridged waveguide slot array 300 is implemented in 1.8 GHz GSM systems, 2.2 GHz WiFi Systems, or 3.5 GHz WiMax systems.

Figure 4A:
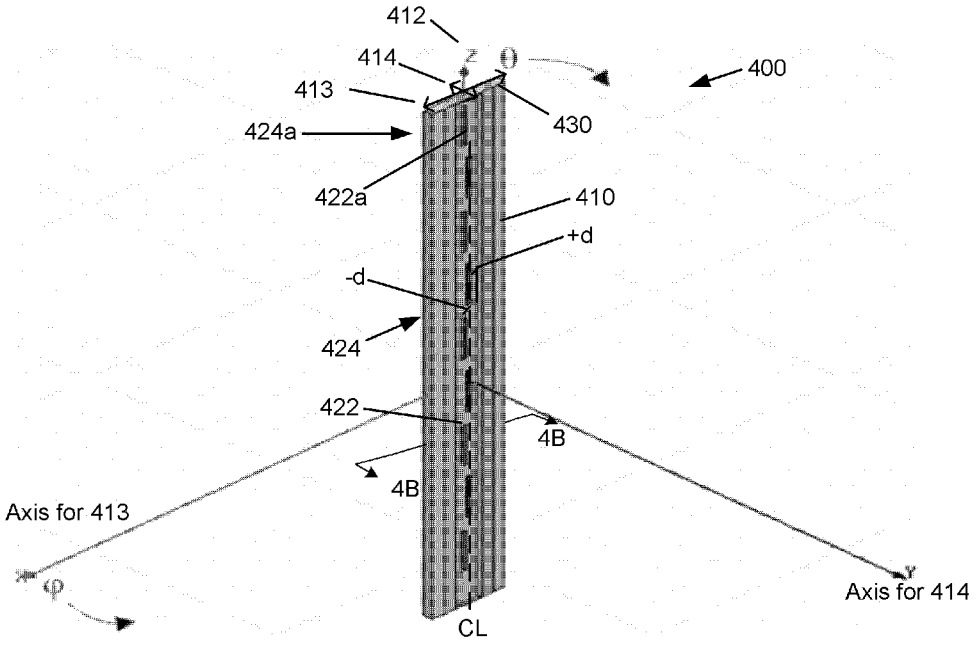
FIG. 4A illustrates a perspective view of a horizontally-polarized ridged waveguide slot array in accordance with one embodiment of the present invention.

FIG. 4A illustrates a perspective view of one embodiment of a horizontally-polarized ridged waveguide slot array 400 in accordance with one embodiment of the present invention. The array 400 includes a waveguide slot body 410 having longitudinal slots 422 and 424 disposed thereon. The waveguide slot body 410 is oriented along a longitudinal axis (exemplary shown as the z-axis) 412 which is the direction of propagation of a signal injected therein.

Transverse to the longitudinal axis 412, the waveguide slot body 410 defines a waveguide aperture (further detailed below) having a major dimension 413 (shown along the x-axis) and a minor dimension 414 (shown along the y-axis). The major dimension 413 defines the lowest frequency of operation for the array 400, and in one embodiment, is less than 0.5 λ in its dimension. The waveguide slot body 410 includes longitudinal slots 422 and 424 disposed on respective opposing broadsides of the waveguide body 410. Each slot 422 is offset a predefined distance "d" from a center line "CL" of the waveguide slot body 410, whereby adjacent slots on this broadside wall are offset in opposing directions from the center line CL. Longitudinal slots 424 are disposed on the opposing broadside wall of the waveguide slot body 410 and represent a continuation of longitudinal slots 422 bored through the hollow waveguide slot body 410 into the second/opposing broadside wall. As such, opposing longitudinal slots 424 are disposed at substantially the same coordinates along the second/opposing broadside wall as slots 422 are disposed along the first broadside wall. An end cap 430 is located at the top of the array 400. The first longitudinal slots (top most, and starting most proximate to end cap 430) on each broadside of the waveguide slot body 410 are identified with reference indicia 422*a* and 424*b*.

Figure 4B:
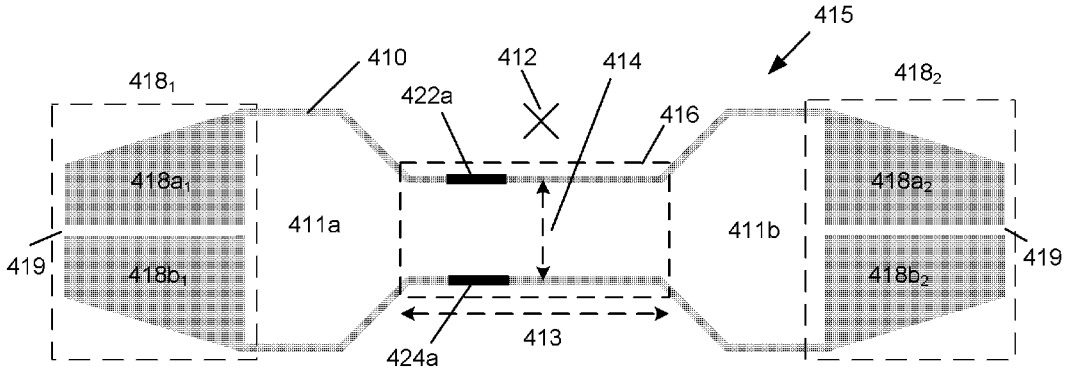
FIG. 4B illustrates an exemplary waveguide aperture for the horizontally-polarized ridged waveguide slot array shown in FIG. 4A.

FIG. 4B illustrates an exemplary waveguide aperture 415 for the horizontally-polarized ridged waveguide slot array 400 shown in FIG. 4A. The longitudinal slots 422 and 424 (only opposing slots 422*a* and 424*a* are shown to avoid obscuring the drawing) are disposed on opposing broadside walls of the waveguide body 410. The waveguide aperture 415 includes the waveguide slot body 410 and two ridged waveguide sections $\mathbf{418}_1$ and $\mathbf{418}_2$ attached to the opposing sides of the waveguide body 410. The waveguide slot body 410 includes two tapered waveguide sections 411*a* and 411*b* which are laterally opposed along the major dimension axis 413 of the waveguide aperture 415, and a narrowed waveguide section 416 which is disposed between the two tapered waveguide sections 411*a* and 411*b*. As shown, the major dimension 413 is the major dimension of the narrowed waveguide section 416, and this dimension, in one embodiment of the invention, is less than 0.5 λ. In an exemplary embodiment, the cross-sectional dimension of the narrowed waveguide section 416 is 0.20 λ (w)×0.009 λ (h). Exemplary, each tapered waveguide section 411*a* and 411*b* measures 0.085 λ (w)×0.09 λ (h), tapering down to a height of 0.009 λ (h), as shown.

As shown, longitudinal slots 422 and 424 (only slots 422*a* and 424*a* are depicted to avoid obscuring the drawing) are disposed (e.g., cut) in the narrowed waveguide section 416 on respective broadsides thereof. In the illustrated embodiment, a plurality of longitudinal slots 422 are provided such that each is offset a predefined distance d from a center line CL along the longitudinal axis 412 of the ridged waveguide body 410, adjacent longitudinal slots being offset in opposing directions from the center line. The offsetting distance can be selected based upon the desired operating frequency. Opposing longitudinal slots 424 are disposed on the opposing broadside wall within the narrowed waveguide section 416 of the waveguide body 410 at substantially the same coordinates opposite the longitudinal slots 422. In an exemplary embodiment, dimension "d" is 0.045 λ, and the center to center slot spacing is 0.56 λ, with each slot measuring 0.43 λ in the longitudinal directional and 0.046 λin the direction normal thereto.

As known in the art, the radiation characteristics on the horizontal plane (azimuth pattern) of the ridged waveguide slot array 400 is determined largely by the relative distance between the opposing broadside slots 422 and 424 on the horizontal plane, and the shape of outer contour of the ridged waveguide slot array 400 separating these two sets of slots. Each slot (e.g., 422*a*) will typically have the same phase angle relative to its corresponding slot (e.g., 424*a*), (e.g., the phase angle being, e.g., 0 degrees relative to the longitudinal axis of the waveguide slot body), each slot operable as a resonator to excite a current on the waveguide outer wall to contribute to the total radiation pattern. In order to create a uniform signal distribution around the 360° area of the array, the distance between corresponding (opposing broadside) slots (e.g., 422*a* and 424*a*) should be relatively short (e.g., less than 0.01 λ), as it would prove difficult to compensate for the phase differences between the two corresponding slots if the slots were separated by a significant distance.

The array 400 includes two laterally-opposed ridged waveguide sections $\mathbf{418}_1$ and $\mathbf{418}_2$. Each of the ridged waveguide sections $\mathbf{418}_1$ and $\mathbf{418}_2$ includes two spaced apart opposing ridges 418*a* and 418*b* which extend longitudinally along opposing lateral sides of the waveguide slot body 410. Further exemplary, the exterior surfaces of each ridged waved section $\mathbf{418}_1$ and $\mathbf{418}_2$ may be tapered to further provide a more uniform electrical path between the opposing broadside slots (e.g., 422*a* and 424*a*) on the waveguide slot body 410.

The external surfaces of sections $418_1$ and $418_2$ may be formed in the shape other contours, e.g., elliptical, circular, or exponential tapers or any other shape. Exemplary, each ridged waveguide section $418_1$ and $418_2$ measures 0.13 λ (w)×0.004 λ (h), tapering down to a height of 0.0036 λ (h), as shown. Gap 419 providing separation between the opposed ridges $418a_1$ and $418b_1$ and opposed ridges $418a_2$ and $418b_2$ measures 0.001 λ (h). In another embodiment, the gap 419 is removed and the two opposing ridges 418*a* and 418*b* are brought into contact with each other, or alternatively form a single piece. In such an embodiment, the exterior surfaces of each waveguide section $418_1$ and $418_2$ are described as above, i.e., each may be tapered or otherwise shaped (elliptical, circular, exponential tapers) to provide a more uniform electrical path between opposing broadside slots (e.g., 422*a* and 424*a*) on the waveguide slot body 410.

Use of the ridged waveguide sections $418_1$ and $418_2$ provides more freedom to adjust the horizontal radiation pattern of the array 400, as the outer contour of the ridged waveguide sections $418_1$ and $418_2$ can be modified/shaped to adjust the electrical length between opposing broadside slots 422*a* and 424*a*, thus providing a means to optimize the horizontal radiation pattern. In the illustrated embodiment, the ridged waveguide sections provide capacitive coupling along lateral sides of the waveguide slot body 410 down the longitudinal axis 412. While each ridged waveguide section 418 is illustrated as two spaced-apart opposing ridges 418*a* and 418*b*, those skilled in the art will appreciate that the same electrical effect can be obtained using other means, for example a single ridge which extends from the upper or lower wall to close proximity to the opposing wall to provide the desired (e.g., capacitive) coupling effect therebetween. Further, the same electrical effect can be obtained using discrete components, such as capacitive elements disposed along the lateral sides of the waveguide slot body 410.

Figure 4C:
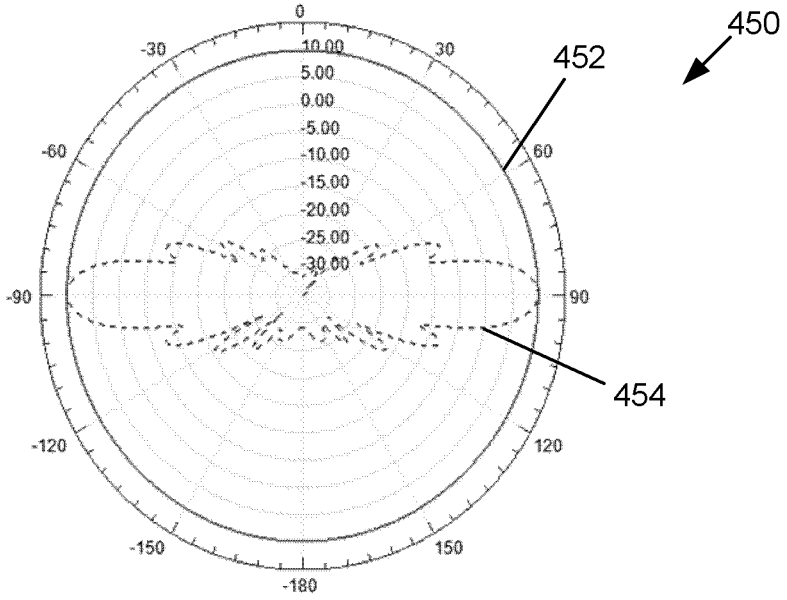
FIG. 4C illustrates the elevation and azimuth radiation pattern for the ridged waveguide slot array of FIG. 4A.

FIG. 4C illustrates the elevation and azimuth radiation pattern for the horizontally-polarized ridged waveguide slot array 400 of FIGS. 4A and 4B at a frequency of 0.545 GHz where the azimuth radiation pattern 452 is shown at θ=90° and the elevation radiation pattern 454 is shown at ϕ=90°. As can be seen, the ridged slot array 400 has a more uniform azimuth radiation pattern 452, exhibiting less than 1 dB compared to 4 dB to the azimuth radiation pattern 252 of the conventional slot array.

Figure 4D:
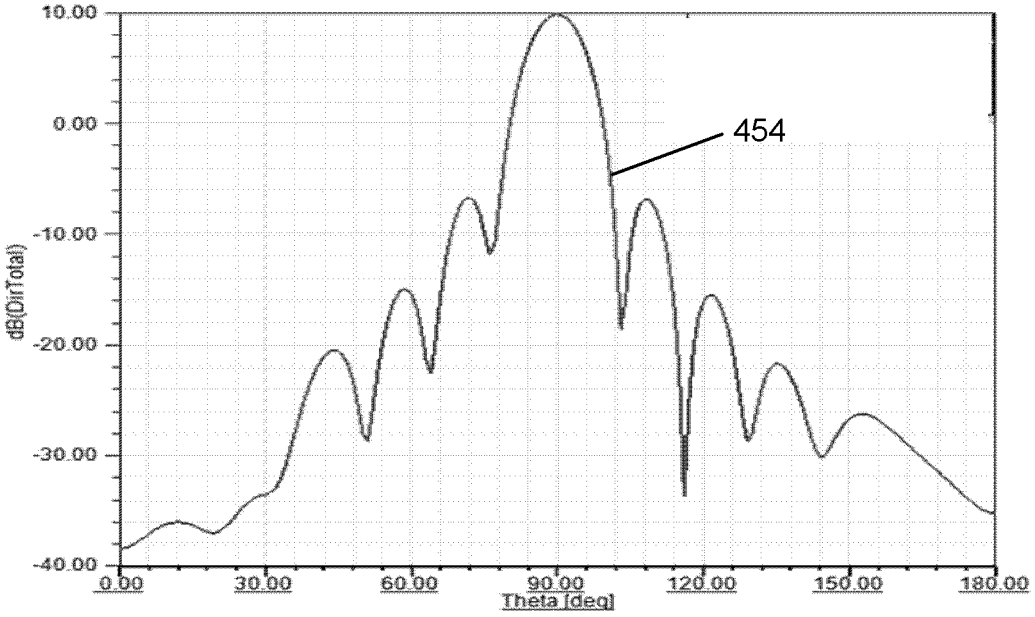
FIG. 4D illustrates the elevation radiation pattern for the ridged waveguide slot array of FIG. 4A at $\phi=90°$ over angle $\theta$ between 0° and 180°.
Figure 4E:
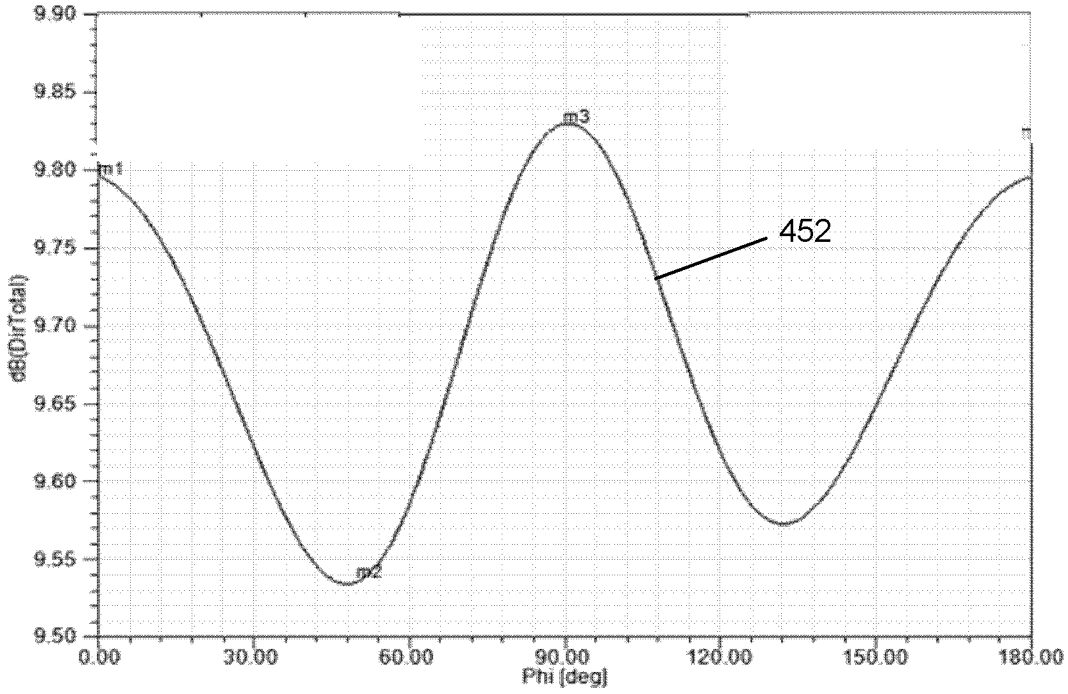
FIG. 4E illustrates the azimuth radiation pattern for the ridged waveguide slot array of FIG. 4A at $\theta=90°$ over angle $\phi$ between 0° and 180°.

FIG. 4D illustrates the elevation radiation pattern 454 at ϕ=90° over angle θ between 0° and 180°. FIG. 4E illustrates the azimuth radiation pattern 452 at θ=90° over angle ϕ between 0° and 180°. As can be seen, the ridged slot array has a uniform azimuth radiation pattern 452, exhibiting less than 1 dB variation compared to 4 dB to the azimuth radiation pattern 252 of the conventional slot array.

The ridged waveguide slot array 300 and 400 may be manufactured using a variety of materials and processes. Materials such Kovar, brass, aluminium, and other materials used for the construction of waveguides may be employed. Further, different manufacturing techniques can be used to produce the arrays 300 and 400, for example numerically-controlled machining, casting or other waveguide construction techniques.

As readily appreciated by those skilled in the art, the described processes and operations may be implemented in hardware, software, firmware or a combination of these implementations as appropriate. In addition, some or all of the described processes and operations may be implemented as computer readable instruction code resident on a computer readable medium, the instruction code operable to control a computer of other such programmable device to carry out the intended functions. The computer readable medium on which the instruction code resides may take various forms, for example, a removable disk, volatile or non-volatile memory, etc.

The terms "a" or "an" are used to refer to one, or more than one feature described thereby. Furthermore, the term "coupled" or "connected" refers to features which are in communication with each other (electrically, mechanically, thermally, as the case may be), either directly, or via one or more intervening structures or substances. The sequence of operations and actions referred to in method flowcharts are exemplary, and the operations and actions may be conducted in a different sequence, as well as two or more of the operations and actions conducted concurrently. Reference indicia (if any) included in the claims serves to refer to one exemplary embodiment of a claimed feature, and the claimed feature is not limited to the particular embodiment referred to by the reference indicia. The scope of the clamed feature shall be that defined by the claim wording as if the reference indicia were absent therefrom. All publications, patents, and other documents referred to herein are incorporated by reference in their entirety. To the extent of any inconsistent usage between any such incorporated document and this document, usage in this document shall control.

The foregoing exemplary embodiments of the invention have been described in sufficient detail to enable one skilled in the art to practice the invention, and it is to be understood that the embodiments may be combined. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined solely by the claims appended hereto.

What is claimed is:

1. A ridged waveguide slot array, comprising:

a waveguide slot body having one or more walls that define a longitudinal axis of the waveguide slot body, the waveguide slot body comprising a plurality of slots disposed on the one or more walls; and a ridged waveguide section attached to the waveguide slot body, the ridged waveguide section comprising two spaced-apart opposing ridges disposed on the one or more walls of the waveguide slot body and extending along the longitudinal axis of the waveguide slot body, wherein the waveguide slot body defines a waveguide aperture having a major dimension and a minor dimension, wherein the major dimension of the waveguide aperture is less than one-half wavelength of a signal intended for propagation therein, wherein the ridged waveguide section extends along a longitudinal center line of the waveguide slot body, wherein the ridged waveguide section comprises two ridges opposed along an axis of the minor dimension of the waveguide aperture, the two opposing ridges extending along the longitudinal axis of the ridged waveguide body internally therein, and wherein the waveguide body comprises two side surfaces and two broadside surfaces, and wherein the plurality of slots comprises a plurality of edge slots disposed on at least one of the side surfaces.

2. The ridged waveguide slot array of claim 1, wherein the plurality of slots comprises first and second edge slots, and wherein the first edge slot is disposed at a predefined angle β in a positive angular orientation relative to the axis of the minor dimension of the waveguide aperture, and a second edge slot is located adjacent to the first edge slot and is disposed at said predefined angle β in a negative angular orientation relative to the axis of the minor dimension of the waveguide aperture.

3. The ridged waveguide slot array of claim 1, wherein each edge slot extends to each of the two broadside surfaces and to each of the side surfaces.

4. The ridged waveguide slot array of claim 1, wherein the ridged waveguide slot array is a vertically-polarized slot array antenna.

5. A communication system having a ridged waveguide slot array, the ridged waveguide slot array comprising:

a waveguide slot body having one or more walls that define a longitudinal axis of the waveguide slot body, the waveguide slot body comprising a plurality of slots disposed on the one or more walls; and a ridged waveguide section attached to the waveguide slot body, the ridged waveguide section comprising two spaced-apart opposing ridges disposed on the one or more walls of the waveguide slot body and extending along the longitudinal axis of the waveguide slot body, wherein the waveguide slot body defines a waveguide aperture having a major dimension and a minor dimension, wherein the major dimension of the waveguide aperture is less than one-half wavelength of a signal intended for propagation therein, wherein the ridged waveguide section extends along a longitudinal center line of the waveguide slot body, wherein the ridged waveguide section comprises two ridges opposed along an axis of the minor dimension of the waveguide aperture, the two opposing ridges extending along the longitudinal axis of the ridged waveguide body internally therein, and wherein the waveguide body comprises two side surfaces and two broadside surfaces, and wherein the plurality of slots comprises a plurality of edge slots disposed on at least one of the side surfaces.

6. The communication system of claim 5, wherein the plurality of slots comprises first and second edge slots, and wherein the first edge slot is disposed at a predefined angle β in a positive angular orientation relative to the axis of the minor dimension of the waveguide aperture, and a second edge slot is located adjacent to the first edge slot and is disposed at said predefined angle β in a negative angular orientation relative to the axis of the minor dimension of the waveguide aperture.

7. The communication system of claim 5, wherein each edge slot extends to each of the two broadside surfaces and to each of the side surfaces.

8. The communication system of claim 5, wherein the ridged waveguide slot array is a vertically-polarized slot array antenna.

* * * * *